United States Patent [19]

Gerich

[11] 4,304,529

[45] Dec. 8, 1981

[54] APPARATUS AND METHOD FOR DELIVERING AND METERING FLUIDS

[76] Inventor: Horst Gerich, 3183 San Fernando Rd., Los Angeles, Calif. 90065

[21] Appl. No.: 79,094

[22] Filed: Sep. 26, 1979

[51] Int. Cl.[3] ..... F04B 17/00

[52] U.S. Cl. ..... 417/349; 417/393; 417/404

[58] Field of Search ..... 417/323, 507, 427, 349, 417/426, 318, 390, 393, 404

[56] References Cited

U.S. PATENT DOCUMENTS

| | | | |
|---|---|---|---|
| 2,376,838 | 5/1945 | Walter | 417/318 X |
| 2,814,551 | 11/1957 | Broeze et al. | 417/349 X |
| 3,825,122 | 7/1974 | Taylor | 417/323 X |
| 4,030,860 | 6/1977 | Standlick | 417/349 X |
| 4,093,404 | 6/1978 | Soehngen et al. | 417/507 X |

FOREIGN PATENT DOCUMENTS

| | | | |
|---|---|---|---|
| 208005 | 6/1956 | Australia | 417/507 |

*Primary Examiner*—Carlton R. Croyle
*Assistant Examiner*—Edward Look

[57] ABSTRACT

A metering system for delivering and metering two combinable and cooperatable liquids, in predetermined ratios in order to enable ultimate combining of such liquids or the fluids. The apparatus comprises a first discrete valve mechanism which is capable of receiving a first fluid from a source and a cooperating first discrete metering mechanism; a pumping mechanism for receiving the fluid from and directing fluid to this first valve mechanism. The apparatus also comprises a second discrete valve mechanism capable of receiving a second fluid from a source and an associated second discrete metering mechanism; a pumping mechanism for receiving fluid from and directing fluid to this valve mechanism. An actuating device operatively connects the first and second valve mechanisms and the first and second metering mechanisms in order to enable the first metering mechanism to pump the first fluid to and from the first valve mechanism and the second fluid to and from the second valve mechanism. The valve mechanisms are capable of metering the first and second fluids in proper predetermined amounts. The fluids may be combined at a mixing member as for example, a mixing gun.

21 Claims, 9 Drawing Figures

APPARATUS AND METHOD FOR DELIVERING AND METERING FLUIDS

BACKGROUND OF THE INVENTION

1. Field of the Invention

This invention relates in general to certain new and useful improvements in apparatus and method for delivering two cooperatable and combinable fluids in predetermined ratios to enable ultimate combining of such fluids, and more particularly, to apparatus and method of the type stated which employ discrete metering means and discrete valve means along with a discrete associated actuating means to enable a continuous supply of the two fluids in the proper predetermined rations.

2. Brief Description of the Prior Art

In the formulation of various compositions it is oftentimes necessary to mix two or more fluids, typically liquids in proper predetermined ratios. In the use of various compounds which must be prepared on an in-situ basis, that is at a site of use, two or more liquids are mixed in proper predetermined ratios and then used before the resultant compound sets or cures. For example, in sealant compounds, it is oftentimes necessary to mix a base liquid, such as an isocyanate compound with a catalyst in order to create the reaction and the ultimate formation of the desired compound.

In many cases, it is necessary to combine the liquids very shortly before use of the resultant compound inasmuch as they are then capable of being applied in a desired thickness and manner and before the compound sets and hardens. If the liquids are not combined and dispensed for application shortly after the combination, they become hardened and not capable of being applied properly or even adhering to the surface to which they are applied.

There has been at least one system in the prior art which was able to pump, meter, mix and dispense a compound prepared from liquid components taken directly from liquid containers for such components. This prior art system utilized a pair of pumps and a pair of valves essentially as an integrated system and is produced by the Semco Company of Glendale, CA and known as the model 1409 mixer. This system employed a first valve member and a first pumping member as a combined structure in one housing and a second valve member and associated pumping member as a combined structure in a second housing. Thus, all of the components were not discrete components.

By virtue of the fact that this prior art apparatus was constructed essentially with cast metal housings and essentially as an integrated unit, there were a number of sharp angled corners in the liquid ducts formed within the apparatus and which materially interfered with proper liquid flow and hence proper mixing of the liquids. Another one of the problems was the down time involved when it was necessary to replace one or more of the components forming part of the integrated system. These and other problems were inherent with the presently available system for mixing and dispensing two or more liquids in a proper predetermined ratio. This particular Semco prior art device is hereinafter described in more detail in connection with the accompanying drawings.

OBJECTS OF THE INVENTION

It is, therefore, a primary object of the present invention to provide an apparatus for delivering two combinable and cooperatable fluids in predetermined ratios to enable an ultimate combining of these fluids which comprises first and second discrete valve means for receiving the two fluids, and first and second discrete metering means associated with the respective valve means in order to meter and deliver the two fluids in the proper predetermined ratios.

It is another object of the present invention to provide an apparatus of the type stated which utilizes a coupling means existing between the first and second valve means and the first and second metering means which permits the metering means to cooperate with the associated valve means in order to meter the first and second fluids in the proper predetermined ratios.

It is an additional object of the present invention to provide an apparatus of the type stated which is operable on a continuous basis and in which the first and second metering means are pumping means having pistons reciprocable in opposite direction and which operate in coordination with the associated first and second valve means in order to maintain a continuous supply of the first and second fluids.

It is a further object of the present invention to provide an apparatus of the type stated which can be manufactured at a relatively low unit cost and which is highly reliable in its operation.

It is another salient object of the present invention to provide a method of delivering two combinable and cooperatable fluids in predetermined ratios to a mixing member for combining streams of such fluids in a relatively economical manner with a minimal amount of manual attention.

With the above and other objects in view, my invention resides in the novel features of form, construction, arrangement and combination of parts presently described and pointed out in the claims.

BRIEF SUMMARY OF THE DISCLOSURE

An apparatus for metering two combinable and cooperable fluids, preferably liquids, in predetermined ratios to enable ultimate combining of such liquids or fluids. The apparatus in a broad aspect comprises a first discrete valve means capable of receiving a first fluid from a source thereof. In addition the apparatus comprises a first metering means which is operatively connected to the first valve means for receiving fluid from and directing fluid to the first valve means.

The apparatus includes a second discrete valve means capable of receiving a second fluid from a source thereof. In addition, a second metering means is operatively connected to the second valve means for receiving fluid from and directing fluid to the second valve means. These first and second metering means are each a discrete unit. Thus, in a preferred embodiment of the present invention, there is a discrete first valve, a discrete second valve, a discrete first metering means and a discrete second metering means. While the apparatus of the invention is effective in mixing and delivering fluids other than liquids, it is hereinafter described in connection with mixing and delivering liquids, and typically combinable and cooperable liquids.

The apparatus of the invention also comprises an actuating means which operatively connects the first and second valve means and the first and second metering means to enable the first metering means to deliver the first liquid to and from the first valve means in a predetermined ratio or proportion with respect to the second metering means metering the second liquid to and from the second valve means.

In one aspect of the invention, the actuating means is actually an actuating coupling means. Thus, an actuator rod extends between the first metering means and the second metering means. In like manner, the actuating means comprises an actuator such as a pneumatic piston-cylinder which operates the first valve means and the second valve means. Thus, a linkage rod is connected to the pneumatic cylinder and the first valve means and a second linkage rod is connected to the pneumatic cylinder and the second valve means. Further, a coupling mechanism is operatively interposed between the pneumatic cylinder and the actuating rod which, in turn, connects the two pumping means. A solenoid, such as a pneumatic type device in the nature of solenoid may be connected to or form part of the actuator in response to control by ball actuators.

In one aspect of the invention, the metering means each adopt the form of pumping means since they serve not only to meter the fluids in a manner as hereinafter described, but forceably deliver the fluids to a mixing source. These pumping means are driven by external pumps not actually connected to the pumping means but enable the pumping means to apply a driving pressure to the fluids, and thus the metering means are considered pumps or pumping means.

The pumping means are double acting cylinder-piston arrangements and each cylinder is sized so that the pumping means each function as metering devices. Thus, each pumping means operates in a manner to pump liquid from a source into one sides of the cylinder and out of the other side of the cylinder to the valve means for ultimate delivery to a mixing member. Upon actuation by the pneumatic cylinder, the actuating rod will cause the reverse action of each of the pumping means. In this way, each pumping means will pump liquid from the side which initially was receiving liquid from the source and receive liquid from the source on the side which was initially delivering to the mixing means. In this way, each of the valves and the associated pumping means are cooperatable in a timed relationship.

The metering means or pumping means effectively meter the fluids since the cylinders of each unit are sized so that only the proper amounts of the liquids can be dispensed since each piston moves over the same distance, the amount of liquid dispensed is effectively controlled by the overall diametral size of the cylinders. Then, if one cylinder has a size less than the other, the amount of liquid dispensed from that cylinder is proportionally less than the other.

In one preferred embodiment of the invention, the mixing means forms part of the apparatus and the first and second valve means are operatively connected to the mixing means in order to enable the mixing of the first and second liquids in a proper predetermined ratio. As indicated previously, the actuating means interconnects each of the valve means and the individual discrete pumping means. The valve means are actually operated in conjunction with the pumping means and the change of state of the pumping means that is, the change of direction of the piston within each of the pumping means. Thus, as in the preferred aspect where the pumping means are dual acting piston-cylinder devices, the valve means operates to permit fluid from the source to be pumped into one side of the cylinder when the piston is moving in one direction and into the other side of the cylinder when the piston is moving in the opposite direction. The actuating means thereby causes the first and second discrete piston-cylinder (pumping) devices to reverse directions substantially simultaneously and also to substantially simultaneously change the flow from each of the valve means which are preferably four-way valves.

This form of invention is highly effective in delivering and permitting combination of two liquids which are combinable and cooperatable in a manner to form a substance which will harden. Thus, for example, the first liquid may be a base liquid capable of being catalyzed and the second liquid is a liquid catalyst capable of being mixed with and catalyzing the base liquid.

As used herein, the term "discrete" is used to mean a separate member. Thus, a first discrete valve means is discrete from the second valve means in that both are distinct members. The same holds true of the metering units in which each are discrete with respect to each other and with respect to the valve means. In this respect, the first and second discrete metering means may be connected by an actuating means, although in this respect, they are only connected by the actuating means and other than that are separate from each other. The same holds true with respect to each of the valve means in that they are connected only by means of the actuating means, but otherwise are discrete and separate components.

It is true that while the components of the present invention are discrete and may be connected by mechanical linkages of one form or another, they are also connected through fluid lines. For example, the first valve means is connected to the first metering means by liquid delivery tubes or pipes and the same holds true of the second valve means and second metering means. Nevertheless, this does not render these units other than discrete units inasmuch as they could be separated easily and combined in another process without altering the mechanical operation of any of such units.

The present invention also provides a method of delivering two combinable and cooperable fluids, preferably liquids in predetermined ratios to a member for combining the streams of such fluids. This method operates in a manner similar to that previously described in that it also uses two discrete metering units and two discrete valves for combining the fluids in proper predetermined ratios and delivering the fluids to a common mixing station.

The invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
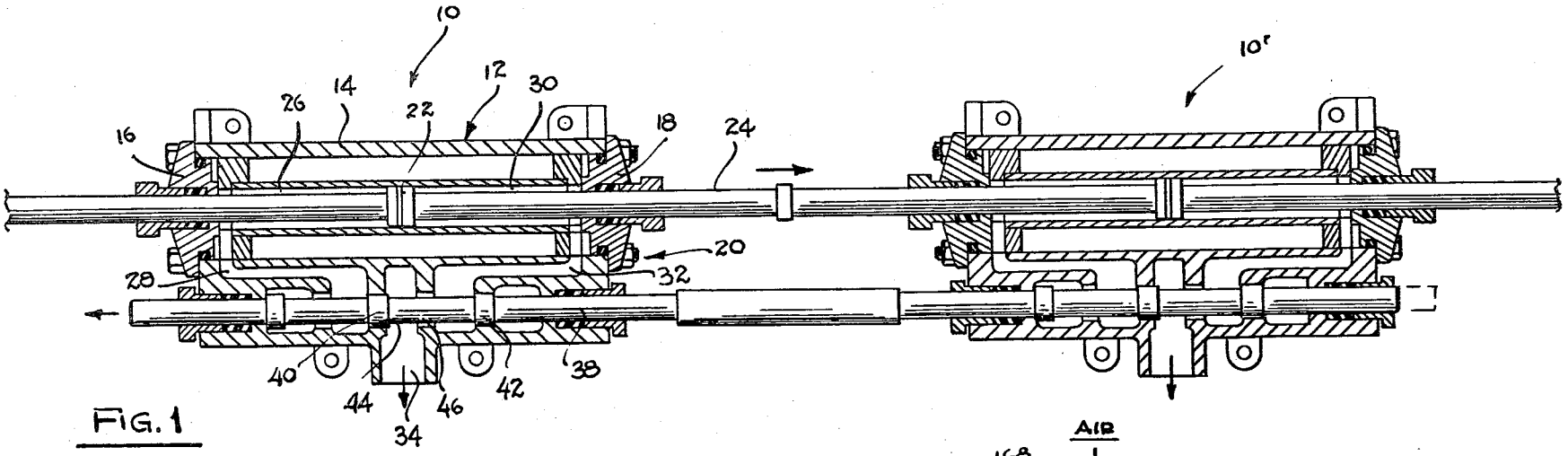
FIG. 1 PRIOR ART
Figure 9:
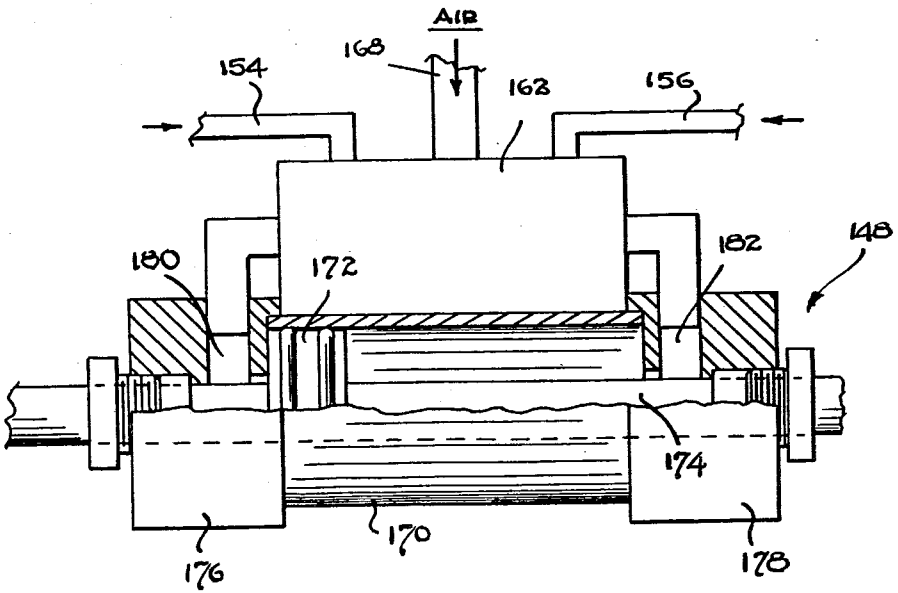
Figure 8:
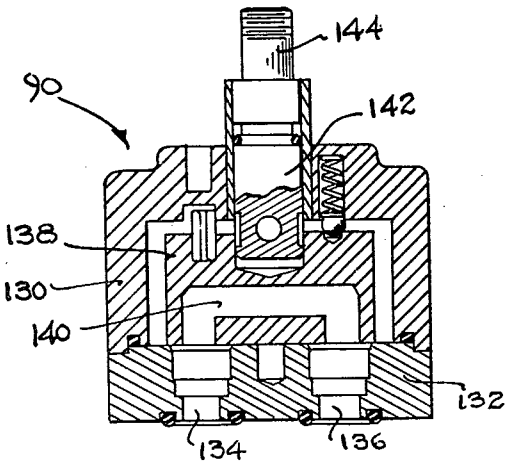
Figure 2:
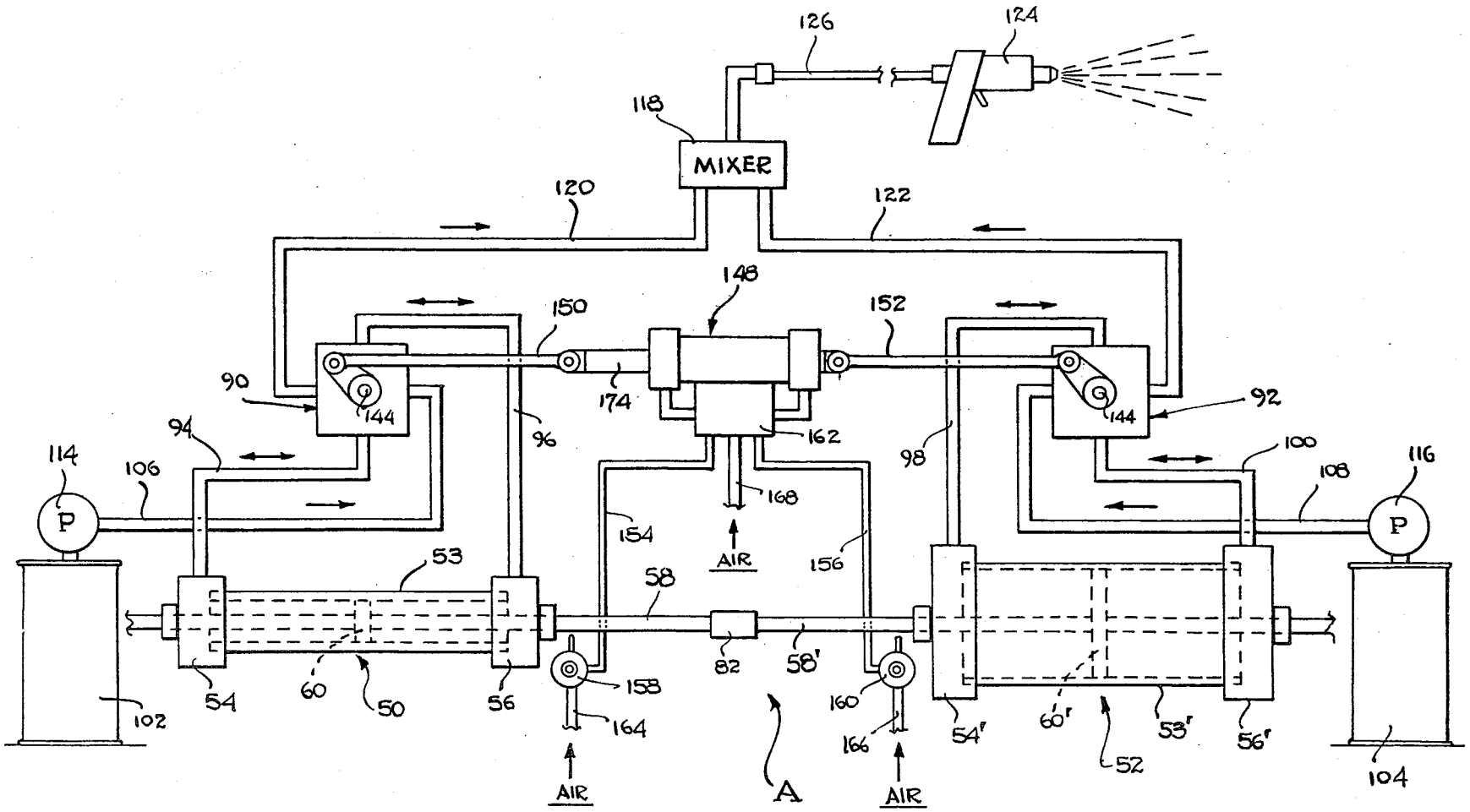
Figure 3:
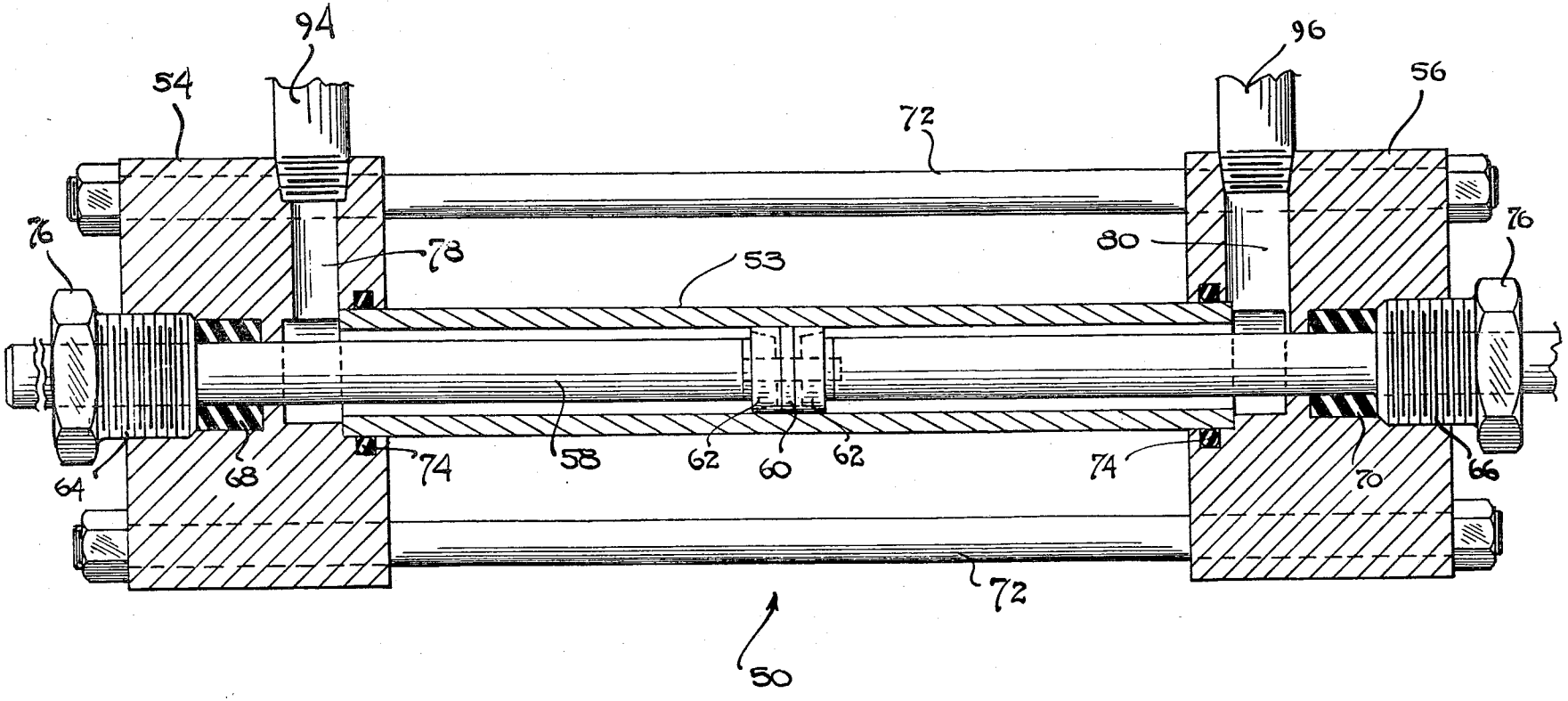
Figure 4:
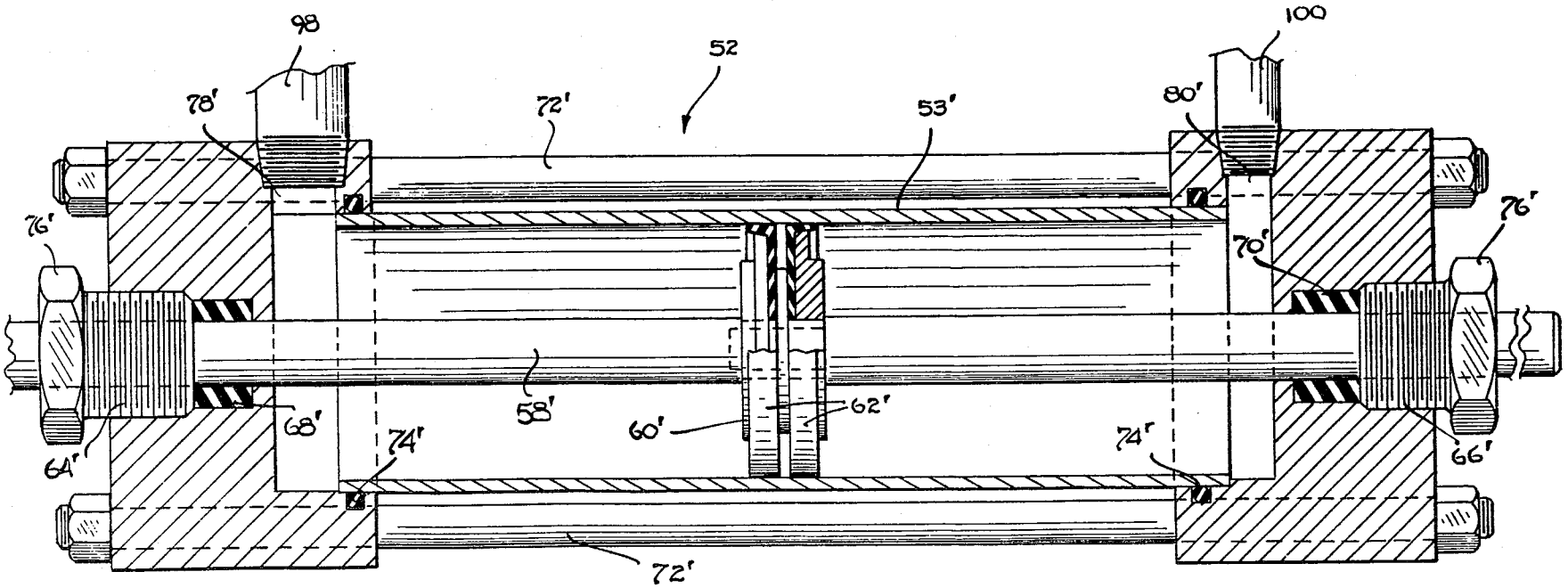
Figure 6:
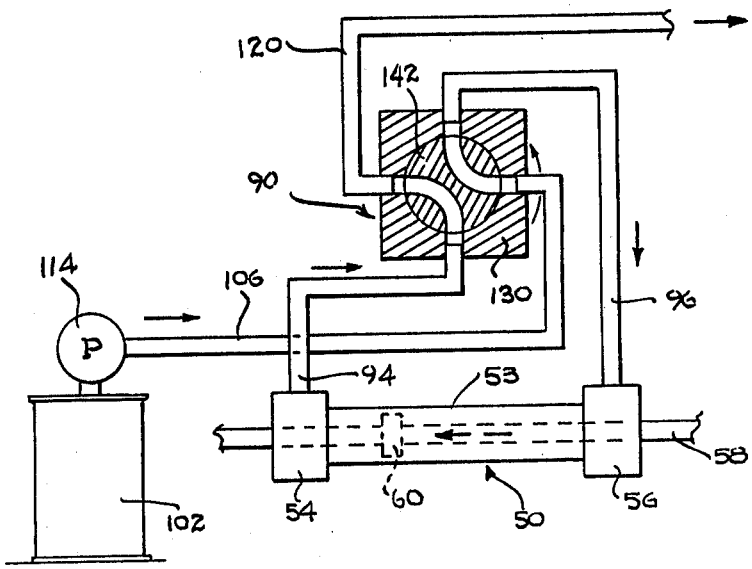
Figure 7:
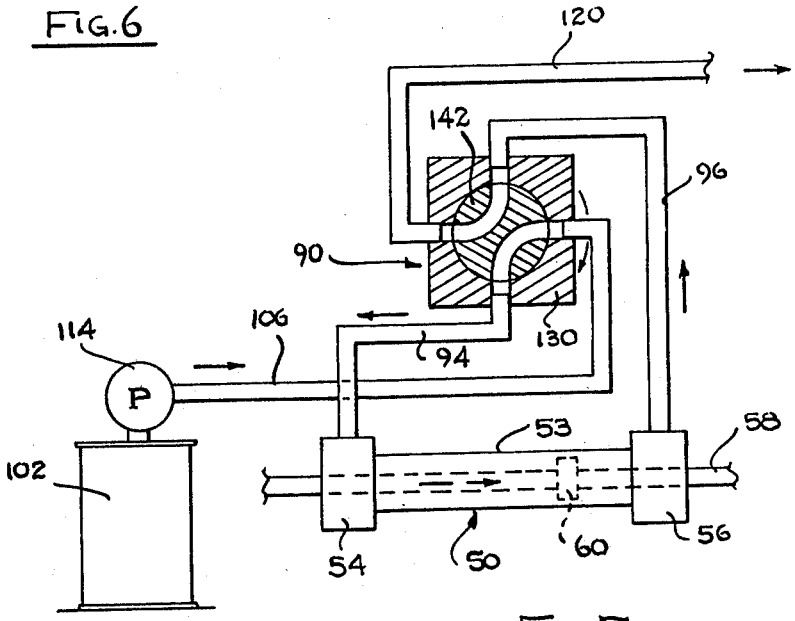
Figure 5:
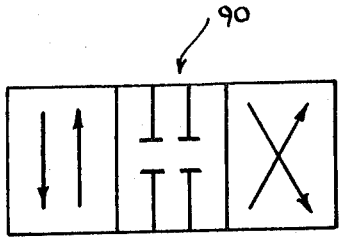

Having thus described the invention in general terms, reference will now be made to the accompanying drawings in which:

FIG. 1 is a vertical sectional view of a prior art liquid puming and mixing apparatus;

FIG. 2 is a schematic side elevational view of a fluid metering and delivering apparatus constructed in accordance with and embodying the present invention;

FIG. 3 is an enlarged vertical sectional view showing one of the discrete metering units used in the apparatus of the present invention;

FIG. 4 is an enlarged vertical sectional view showing the other one of the discrete metering units used in the apparatus of the present invention;

FIG. 5 is a schematic view showing the mode of operation of a four-way acting valve used in the apparatus of FIG. 2;

FIG. 6 is a schematic flow diagram showing the four-way valve in one position;

FIG. 7 is a schematic view, somewhat similar to FIG. 5, and showing the four-way valve in the other position in accordance with the present invention;

FIG. 8 is a side elevational view, partially broken away and in section, of a four-way valve used in the apparatus of the present invention; and FIG. 9 is a schematic side elevational view, partially broken away, of an actuator used in the apparatus of the present invention.

BRIEF DESCRIPTION OF A PREFERRED EMBODIMENT

Referring now in more detail and by reference characters to the drawings which illustrate a practical embodiment of the present invention, P designates a prior art liquid pumping and mixing apparatus and which is presented in vertical sectional view in order to show the operating portions thereof and their relationship with respect to the apparatus of the present invention.

The apparatus P is comprised of two discrete pumping-valve devices or units 10 and 10' in the manner as illustrated in FIG. 1 of the drawings. In this respect, each of the discrete units 10 and 10' are substantially identical to each other and therefore only the discrete unit 10 will be described in more detail. In this respect, it should also be understood that the combined pumping-valve unit 10 is only discrete from the unit 10' although the valve and the pump which could be considered to constitute two components in that the valve-pumping mechanisms 10 are not discrete with respect to each other.

The pumping-valve unit 10 is comprised of an outer casting 12 which is typically a metal casting. Such device is briefly described in the service manual of the model 1409 mixer produced by the Semco Company of San Fernando Road in Glendale, Calif.

This casting 12 includes a cylindrically shaped liquid cylinder 14 having end caps 16 and 18 formed thereon and on its underside, the casting is provided with a housing 20. A reciprocatively shiftable piston 22 is located within the cylinder 14 and is capable of shifting between the two end caps 16 and 18 in the manner as illustrated. The piston 22 is, in turn, mounted on a piston rod 24 which extends axially through the cylinder 14, much in the manner as illustrated in FIG. 1 of the drawings. The piston-cylinder arrangement including the piston 22 and the cylinder 14 act as a type of pump in which a base liquid on the left-hand side, designated by reference numeral 26, can be pumped into or out of a duct 28 extending into the housing 20. In like manner, a liquid on the right-hand side 30 can be pumped into and out of the housing 20 through a liquid duct 32. Moreover, the duct 28 can be connected to a mixing gun through a pipe or conduit (not shown) and connected to a fitting 34 on the housing. In like manner, the duct 32 can be connected to a source of the liquid such as the base liquid through a pipe or conduit (also not shown) and connected to another fitting located immediately behind the fitting 34. These sources may conveniently adopt the form of a container for the liquid.

An actuator rod 38 extends through the housing 20 in the manner as illustrated in FIG. 1 of the drawings. Moreover, this actuator rod includes a plurality of heads 40 and 42 which are capable of being positionally located over orifices 44 and 46 respectively contained in the housing 20 and positioned with respect to the ducts 28 and 32. In this way, when the actuator rod 38 is shifted to the left-hand end as shown, liquid from the source 30 will flow from the right-hand end of the cylinder through the duct 32 and orifice 46 to the outlet fitting 34, and to the mixing gun. Simultaneously, fluid entering through port 33 and duct 28 fills chamber 26. The three heads on the actuating rod alternately uncover and block inlet and exit ports and the head 40 alternately closes the orifices 44 and 46. When the actuator rod 38 has been shifted to the right-hand position, reference being made to FIG. 1, the liquid from the source 26 will flow through the duct 28 and orifice 44 to the outlet 34, for ultimate delivery to the mixing gun. Fluid entering port 35 passes through duct 32 into chamber 30.

It should also be understood in connection with the prior art apparatus P that a similar pumping-valve unit 10' is used with the unit 10. The unit 10 was used to pump and meter a liquid, such as a base liquid, and the unit 10' was used to pump and meter another cooperatable liquid, such as a liquid catalyst. Moreover, it was the intent of this prior art construction to pump and meter two liquids from individual sources thereof to a mixing member for application of a compound formed as a result of mixing the two liquids. However, it should also be observed that the valve and pumping mechanisms are not discrete components, but are effectively combined and integrated in single casings in each of the units 10 and 10'.

There are several problems which arise with this prior art construction. There are typically a number of long liquid carrying hoses in this prior art construction and furthermore, there are a number of 90° or other form of short angle corners located in the liquid delivery ducts within the apparatus. This construction materially interfers with free liquid flow and oftentimes interfers with proper proportioning of the dispensed liquids. The liquids were oftentimes required to flow through sharp angle corners and collected in crevices and thereby interferred with, if not completely blocking, liquid flow. Further, the mixing ratios of the two liquids must be carefully controlled or otherwise, the resultant compound may have permanent deficiencies. However, in this prior art construction, valve control and control of the associated pumping units was not very accurate with a result that the mixing ratios were not very accurate. This was oftentimes due to the fact that the valve arrangements including the valve housing which was integrally formed in the casting were very imprecise. Furthermore, in this prior art construction, spool valves were required and it is difficult to obtain accurate valve control through this type of spool valve arrangement.

Another one of the problems in this type of prior art construction is that the disassembly time and hence down time was quite long in the event of a problem in the apparatus. In the event that there was any problem in either one of the units of the apparatus, it was almost necessary to completely disassemble the apparatus. In order to disassemble this apparatus and clean out the chemical liquid, it took at least approximately four hours. Furthermore, oftentimes due to the number of components and the nature of construction of the components in the apparatus, a complete overhaul was required, thereby requiring the installation of another prior art mixing apparatus. Here again, a very substantial amount of time was required to disconnect and reconnect all the necessary hoses. A further problem with this prior art construction is the fact that there were a large number of moving parts, and hence repair and maintenance requirements were considerable.

The apparatus of the present invention avoids all of these problems as well as other problems in that there are relatively few moving parts. Moreover, the components are discrete components such that if one of the valves or one of the pumps should become inoperative or create problems, it can be easily removed from the entire system such that a new pump or valve could be interposed therefore. In addition to the above, down time is relatively small in that on-site repairs can be made quite easily. Further, there is little or no problem with liquid flow restriction in the various fluid ducts and further, due to the fact that flows are relatively continuous and straight wherever possible, the problems of pulsing and hence improper fluid metering are avoided.

The apparatus A liquid metering and delivery of the present invention is more fully illustrated in FIGS. 2–9 of the drawings and includes a plurality of discrete units or components (hereinafter described) which are connected together by actuating and/or coupling members and liquid carrying pipes. The apparatus A comprises a first pumping means 50 and a second pumping means 52 and both of which are in the form of a piston-cylinder type pump arrangement.

The pumping means 50 and 52 are often referred to as "pumping units" or "pumps" and each are similar in construction and operation. As indicated previously, the pumping units are really metering units inasmuch as they effectively meter the fluids. Moreover, the pumping units do not include a drive mechanism in the same manner as commercially available pumps, due to the fact that they are driven by other fluid driving members, e.g. other remote pumps. Nevertheless, due to the fact that the metering units do drive the liquids through the action of a piston shifting within a cylinder, they are nevertheless considered pumping units, and as such, are referred to as pumping means or pumping units herein.

The first pumping means 50 is designed to pump a first fluid, such as a catalyst, and the second pumping means 52 is designed to pump a second fluid, such as a catalyst base liquid. Therefore, only the details of construction and operation of the first pumping unit 50 is hereinafter described in detail. Moreover, since the second pumping unit is substantially similar in construction, the common parts of the second pumping unit are provided with the same reference numerals as the first pumping unit, except that each of the common parts of the second pumping unit are identified with a prime (').

The first pumping means is illustrated in FIG. 3 and is comprised of a pumping cylinder 53 which is cylindrically shaped and elongate and having end caps 54 and 56 at each of the opposite transverse ends thereof. Moreover, a piston rod 58 having a suitable piston 60 carried therewith is axially shiftable within the cylinder 53.

The piston 60 is preferably constructed in the form of a relatively flat plate and may be provided with an annularly extending cup seal 62, much in the manner as illustrated in FIG. 2 of the drawings. Moreover, the piston rod extends through glands 64 and 66 at each of the opposite ends of the end caps 54 and 56 respectively, much in the manner as illustrated. In addition, these glands 64 and 66 may be provided with suitable packings 68 and 70, respectively.

Each of the pumping units 50 and 52 are provided with longitudinally extending and spaced apart tie-rods 72 and 72' which extend between each of the end caps 54 and 56 in order to provide support and torsional rigidity. Further, conventional O-ring seals 74 are located on the cylinder 53 at or in proximity to the transverse ends of the axially extending cylinder 53, and which seals 74 are located within the end caps 54 and 56 in order to seal the ends of the cylinder within the end caps. Finally, conventional nuts, such as G-nuts 76 are threadedly mounted on ends of each of the glands 64 and 66, much in the manner as illustrated in FIGS. 3 and 4 of the drawings.

Each of the end caps 54 and 56 are provided with liquid ports 78 and 80, respectively, which lead into the opposite ends of the cylinder 53, in the manner as illustrated. In this way, one of the liquid ports 78 can function as an inlet port when the other functions as an outlet port and visa versa.

As indicated above, the pumping unit 52 is substantially similar in construction to the pumping unit 50 and each operate in a similar way. Moreover, both are coordinated to operate together inasmuch as the piston rods 58 and 58' in each of the pumping units 50 and 52 respectively, are connected together through a shaft coupling 82, the latter of which is a conventional shaft coupling for securement to each of the opposed ends of the two piston rods. Thus, when liquid is introduced into the left-hand side of the cylinder 53 through the liquid port 78, liquid will be discharged or pumped through the right-hand liquid port 80 in the end cap 56. This will occur when the piston 60 and hence the piston rod 58 is shifting to the right, reference being made to FIGS. 3 and 4. In like manner, liquid will simultaneously enter the cylinder 53' of the pumping unit 52 through the left-hand liquid port 78' and will discharge from the pumping unit 52 through the right-hand liquid discharge port 80'. This will also occur as the piston 60' in the pumping unit 52 is shifting to the right.

The pumping units effectively meter the two liquids or other fluids in accordance with the diameteral size of the cylinders of the pumping units. By reference to FIG. 2 of the drawings it can be observed that the cylinder of 53 of the pumping unit 50 has a diametral size which is substantially smaller than the cylinder 53' of the pumping unit 52. Inasmuch as the movement of the piston rods 58 and 58' in a linear direction is substantially the same, regardless of the direction of travel the amount of the liquid effectively pumped out of the respective cylinders 53 and 53' is a function of the overall size of the cylinders and particularly the overall diametral size of the respective cylinders 53 and 53'.

The apparatus A of the present invention is uniquely designed so that the cylinders can be easily removed and substituted by larger or smaller cylinders. Thus it is not absolutely necessary to remove the complete pumping unit and substitute a new pumping unit in order to obtain a different ratio of the two liquids. However, even the removal of a pumping unit and substitution of a new pumping unit with a different cylinder diameter can be accomplished easily. For example, it is only necessary to disconnect a few fluid lines and the piston rod from the shaft coupling 82 and then remove the pumping unit. Thereafter a new pumping unit can be connected by merely connecting the same fluid lines and the piston rod to the shaft coupling. Thus, the changing of the liquid mixing ratios, is a relatively simple task with only a small amount of down time compared to commercially available prior art systems which were not designed for changing fluid mixing ratios. With the prior art systems, it was necessary to obtain an entirely new system if the mixing ratio was to be changed.

The pumping unit 50 has its liquid ports 78 and 80 connected to a first separate and discrete valve means 90 and the second pumping unit 52 has its liquid ports 78' and 80' connected to a separate and discrete valve means 92. These valve means are often referred to as "valve units" or "valves" and are preferably 4-way valves. The liquid port 78 of the pumping unit 50 is connected to the valve 90 through a liquid pipe 94 and the liquid port 80 is connected to the first valve 90 through a liquid pipe 96. In like manner, the second valve 92 is connected to the liqud port 78' of the pumping unit 52 through a liquid pipe 98 and again the liquid port 80' is connected to the valve 92 through a liquid pipe 100.

The fluid operation of the 4-way valves 90 and 92 is more fully illustrated schematically, in FIG. 5 of the drawings. Moreover, the operative connection in the apparatus of the invention is more fully illustrated in FIGS. 6 and 7 of the drawings. Finally, one specific embodiment of a 4-way valve which may be used in the present invention is more fully illustrated in FIG. 8 of the drawings. By further reference to FIG. 5, it can be observed that in one aspect, flow is straight through, that is when the valve is located in one position. When the valve has been shifted to the other position, flow is crossed as indicated in the right-hand portion of FIG. 5. This form of valve pattern is referred to as the "closed center" valve flow arrangement.

Each of the valves 90 and 92 are individually connected to separate sources of liquid as for example, liquid containers 102 and 104. In this case, the liquid containers could be the drums, e.g. 55 gallon drums of the type normally used to haul and store such liquids. Otherwise, special containers could be provided if desired. The liquids in these containers are often referred to as the A-fluid or "A-liquid" and the B-fluid or "B-liquid". Moreover, in a preferred aspect of the invention when cooperatable and combinable liquids are being used to form a specific compound or composition such that the liquids react, one of the liquids is typically a base liquid and the other of the liquids is a catalyst. For purposes of briefly illustrating and describing the invention, it will be assumed that the A-liquid in the container 102 is a catalyst and the B-liquid in the container 104 is a base liquid.

The materials used in the construction of the valve units and the associated pumping units as well as the various liquid delivery pipes would be selected so as to be compatable with the liquids being pumped and metered. The liquids are compatable in the sense that they would not unduly corrode the materials used in the construction of these components and the materials would not be likely to restrict or interfere with liquid flow. Further, the materials used in the construction of these components should not react in any way with the liquids. It should also be understood that the various components, such as the pipes and the pumping units and the valves could be properly lined with non-corrosive material to prevent deleterious effects. Finally each of the components of the present invention are designed so that they can be easily jacketed in order to maintain a temperature controlled environment, e.g., a cold or hot temperature around each of the components.

Each of the containers 102 and 104 are respectively connected to the individual valves 90 and 92 through liquid delivery pipes 106 and 108, respectively. Individual pumping means, as for example, liquid pumps 114 and 116, could be connected to the liquid containers 102 and 104, respectively, if desired. In addition, individual pumps (not shown) could be connected in the liquid delivery lines 106 and 108, respectively, if desired. In this way, when the pumps associated with each of the containers 102 and 104 have been energized, the liquids in these containers will be delivered to the two halves 90 and 92. In accordance with the positions of the valves, the liquid will then be introduced into each of the individual pumping units 50 and 52.

Each of the valves 90 and 92 are also connected to a separate mixing means such as a conventional mixing unit 118 through valve discharge pipes 120 and 122, in the manner as illustrated in FIG. 2 of the drawings. The mixing unit 118 may be a mixing gun or otherwise, it could be connected to a conventional mixing gun 124 through a connecting pipe 126, as in the embodiment as illustrated in FIG. 2.

Each of the valves 90 and 92 preferably have the same position during the operation of the apparatus A of the invention. Here again, the construction and operation of the valve 92 is substantially similar to that of valve 90 and accordingly, only the construction and operation of the valve 90 is hereinafter described in more detail.

One position of the valve 90 is illustrated in FIG. 6 of the drawings and the opposite position of this valve 90 is more fully illustrated in FIG. 7 of the drawings. Thus, when the valve 90 is in the position as illustrated in FIG. 6, liquid will be introduced through the liquid delivery pipe 106 to the valve 90 and through the pipe 96 to the liquid port 80 where it is thereupon introduced into the right-hand side of the pumping unit 50. In this position, the pumping means 50 operates so that the piston 60 and the piston rod 58 are shifting to the left as indicated in FIG. 6. Moreover, when the valve 90 is also in this position, liquid is being pumped out of the pumping unit 50 from the left-hand end and through the liquid port 78 back to the valve 90. Further, the liquid is actually being pumped directly through the valve 90 and into the liquid discharge pipe 120 to the mixer 118.

When the valve 90 has been shifted to the other of the positions, the liquid flow path is reversed with respect to the associated pumping unit 50. In this case, as illustrated in FIG. 7, the valve 90 receives liquid from the liquid delivery pipe 106 and directs this liquid through the pipe 94 to the left-hand side of the pumping unit 50 through the liquid port 78. Further, the pumping unit itself is effectively being operated so that the piston 60 and piston rod 58 are being shifted to the right. As this occurs, the liquid will exit the right-hand end of the cylinder 53 through the liquid port 80 and pipe 96 back toward the valve 90. As this occurs, the liquids will flow directly through the valve 90 and through the liquid discharge tube 120 toward the mixer 118.

One form of 4-way valve which may be used and the apparatus of the present invention is made by Snap-tite Inc. of Union City, Pa. under the mark "Direct-Trol" valves. This form of valve is highly effective in that it provides very good throttling characteristics, particularly when used with a pneumatic actuator as hereinafter described. Moreover, this valve is adaptable to a wide range of hydraulic pressures. The valve, as for example, the valve 90, is illustrated in vertical sectional view in FIG. 8 of the drawings and comprises a valve housing 130 having a bottom cap 132 containing the four liquid ports (two as shown in FIG. 8). Thus for example, two ports 134 and 136 are illustrated and two identical ports would be located immediately behind these ports 134 and 136. Disposed within the housing 130 is a central core 138 which is rotatable and includes a pair of ducts 140 (only one shown) which are capable of extending between the four ports on the underside of the base cap 132. In this way, by rotation of the core 138, it is possible to implement the arrangements as illustrated in FIGS. 6 and 7 of the drawings.

The valve 90 is also provided with a valve stem 142 which extends into the housing 130 and is connected to the rotatable core 138 to cause rotation of the same. Moreover, a mounting means 144 is located on the upper end of the valve stem 142 for engagement by an actuating lever as hereinafter described. Thus, when the valve stem 142 is rotated, the core 138 will rotate thereby enabling the various valving arrangements as illustrated in FIGS. 6 and 7 of the drawings.

As indicated previously, the valve 92 is substantially similar in construction and operation to the valve 90; hence, the valve 92 will adopt a construction similar to that as in FIG. 8, a preferred embodiment. The valve 92 will also cause the same valve flows as illustrated in FIGS. 6 and 7.

The apparatus of the invention utilizes an actuating means, preferably in the form of a pneumatic actuator 148. The actuator 148 serves to actuate the various valves 90 and 92 as well as the pumping units 50 and 52. In this respect, the actuator 148 is operatively coupled to actuator rods hereinafter described and coupled to operatively control the piston rods 58 and 58' in a manner to be hereinafter described in more detail, and the actuator 148 is therefore often referred to as an actuating-coupling means.

In one embodiment of the invention, the pneumatic actuator 148 includes a first actuating mechanism 150 in the form of a linkage rod which is connected to the valve 90. The actuating means 148 also includes a second actuating mechanism 152 in the form of a second linkage rod which is connected to the second valve 92, much in the manner as illustrated in the FIG. 2 of the drawings. In this case, the linkage rods 150 and 152 would be connected to the mounting means 144 on each of the valves 90 and 92 as illustrated.

The pneumatic actuator 148 is coupled to the various pumping units 50 and 52 through couplings which include fluid lines 154 and 156 and associated ball actuators or poppets 158 and 160, respectively.

The actuator 148 is provided with an air controller 162 which could be in the form of an electrically operable solenoid. The controller 162 is pressure responsive and is capable of responding to the ball actuators 158 or 160 being contacted by the shaft coupling 82. In this case, each of the ball actuators 158 and 160 are provided with a supply of air, or other gas under pressure, through air inlet lines 164 and 166, respectively, as shown in FIG. 2 of the drawings. Moreover, the controller 162 is provided with an air inlet line 168 which is the main air supply for the actuator 148, in a manner as hereinafter described in more detail.

The air controller 162 which is responsive to air pressure changes as aforesaid, functions as a solenoid in that when a change in air pressure is sensed in either of the lines 154 and 156, the controller will cause the actuator 148 to change the direction of operation. The ball actuators are conventional in construction and when contacted by an object such as the shaft coupling 82 will cause a momentary bleeding of the air from the air inlet lines 164 and 166. Thus, there will be a momentary pressure drop in the lines 154 and 156 which is sufficient to cause the air controller 162 to cause the actuator 148 to change the direction of operation. One form of air controller and actuator combination is commercially available from Mosier Industries, Inc. of Brookville, Ohio and is referred to as their Air Actuator Special Model No. S-20423A. Other air actuators of this type are more fully described in U.S. Pat. No. 3,913,460.

It should be understood, in connection with the present invention, that other forms of actuators could be employed in place of the pneumatic actuator and associated mechanisms, as shown. For example, in place of the ball actuators, microswitches could be used and which would be operable when contacted by the shaft coupling or other member carried by the piston rods. The actuator would be replaced, in this embodiment, with an electrically operable solenoid which would then move and cause the four way valves to change direction.

The pneumatic actuator 148 and associated controller 162 is more fully illustrated in one embodiment in somewhat schematic format, in FIG. 9 of the drawings. In this case, the actuator 148 includes a cylinder body 170 having a piston 172 and a piston rod 174 extending axially through the cylinder 170 and which piston and piston rod is reciprocatively shiftable therein. In this case, the actuator cylinder 170 is provided with end caps 176 and 178, each having air inlets and outlets 180 and 182 as illustrated.

As indicated previously, the actuator 148 was provided with a source of air under pressure. However, in the preferred embodiment as illustrated, the source of air actually comes from the controller 162. Thus, the controller 162 will cause air to enter the cylinder 172 of the actuator 148 through either the left air inlet port 180 or the right air inlet port 182. In accordance with this construction, the air actuator 148 operates much in the same manner as the previously described pumping units 50 and 52 in that when air enters one side of the cylinder and causes shiftable movement of the piston rod it will simultaneously drive air out of the opposite side of the cylinder.

When the piston 172 shifts to one position, the actuator 148 thereby causes the linkage rods 150 and 152 to shift in the same direction. When the actuator 148 is operated to cause the piston 172 to shift as for example, to the right, reference being made to FIG. 9, the linkage rods 150 and 152 will also shift to the right thereby biasing the valves 90 and 92 to one of the two positions.

In operation, a base liquid is pumped from the container 102 thru the valve 90 and also into one side of the pumping unit 50 in the embodiment as illustrated in FIG. 2. In the particular arrangement in FIG. 6, as illustrated, liquid is pumped into the right-hand side of the cylinder 53 through the liquid port 80. Further, as the pumping unit is operating such that the piston 60 is shifting to the left, the catalyst is also simultaneously pumped out of the left-hand side of the cylinder 53 through the liquid port 78 and into the valve 90. This liquid is pumped through the valve 90 and through the pipe 120 to the mixer 118 through the discharge pipe 126.

In like manner, a base liquid from the container 104 is pumped into the valve 92 and through the right-hand side of the cylinder 53' of the pumping unit 52. Inasmuch as the piston 60' of the pumping unit 52 is shifting to the left, the base liquid is also being pumped out of the left-hand side of the cylinder 53' and into the pipe 98 back to the valve 92. Further, this base liquid is being pumped through the valve, and through the discharge pipe 122 to the mixer 118.

As indicated previously, the mixer 118 could be substituted by a mixing gun, as for example, the gun 124 where the two liquid components are mixed in the proper ratios. When the pistons 60 and 60' have reached the left-hand portion of the cylinders 53 and 53', respectively, the shaft coupling 82 will engage the ball actuator 158 thereby causing the air controller to respond to a resultant change of pressure as previously described. As that occurs the air controller 162 will cause the actuator 148 to change directions. This will cause the valves to change from one to the other of the positions thereby permitting liquid flow to enter the left sides of each of the cylinders 53 and 53'. This will in turn, cause the piston rods 58 and 58' and pistons 60 and 60' to shift to the right. As this occurs, the catalyst from the container 102 will be introduced through the left-hand side of the cylinder 53 and the liquid from the base container 104 will be introduced into the left-hand side of the cylinder 53'. Moreover, the catalyst will be pumped out of the right-hand side of the cylinder 53, through the valve 90 and into the mixer 118. In like manner, the base liquid will be pumped out of the right-hand side of the cylinder 53', through the pipe 100 and the valve 92 and into the mixer 118.

This reciprocative process will continue such that there is a continuous flow of the various liquid components and in their proper ratios. It can be observed that inasmuch as the valves 90 and 92 are coordinated in timed relation to the associated pumping mechanisms 50 and 52, and which are all operated respectively through a common actuator 148, that very precise liquid flow can be obtained. Thus, it is possible to obtain the desired ratios of the base liquid to catalyst or other liquid A with respect to a liquid B.

In accordance with the present invention, the problems of mixing ratios have been effectively eliminated in view of the fact that it is possible to maintain very close ratio control of the two liquids. The various problems of shut-off, that is stopping liquid flow at a precise point, has been eliminated and which problems are still inherent in prior art systems. Moreover, by virtue of the very close control of the associated valves and pumping units, there is effectively no pulsing of the liquid that is, there is no excess dripage. Another one of the problems which does not exist in the present invention is that by virtue of the fact that fluid lines have been established to eliminate sharp corners, such as right angle bends, there is little or no liquid restriction. As a consequence, the apparatus of the present invention can operate at a much higher rate of speed when compared to the prior art mixing systems. In addition to the other problems the apparatus of the invention has been found to be highly effective in tests due to the fact that there is little breakdown of the apparatus and if and when breakdown does exist, the amount of down time is relatively small compared to the prior art systems.

Thus, there has been illustrated and described an unique and novel apparatus and method for metering and delivering two or more fluids in predetermined amounts by utilizing individual metering mechanisms and associated valve mechanisms for each fluid, and which therefor fulfills all of the objects and advantages sought therefore. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention or deemed to be covered by the invention which is limited only by the following claims.

Having thus described my invention, what I desire to claim and secure by letters patent is:

1. A metering apparatus for delivering and metering two fluids in predetermined amounts, said metering apparatus comprising:

(a) a first pumping means comprised of a dual acting piston-cylinder arrangement capable of operating in two directions for pumping a first fluid, (b) a second pumping means comprised of a dual acting piston-cylinder arrangement capable of operating in two directions for pumping a second fluid, (c) a first valve having a first valve housing and a first actuable valve mechanism in said first valve housing, said first valve being separate from said first and second pumping means and being operatively connected to said first pumping means by fluid lines, said first valve being operable in a first flow position when said first valve mechanism is in a first flow position and being operable in a second flow position when said first valve mechanism is in a second flow position, said first pumping means receiving said first fluid from a source thereof and operable for causing said first pumping means to deliver said first fluid to a demand station therefor, (d) a second valve having a second valve housing and a second actuable valve mechanism in said second valve housing, said second valve being separate from said first and second pumping means and said first valve and being operatively connected to said second pumping means by fluid lines, said second valve being operable in a first flow position when said second valve mechanism is in a first flow position and being operable in a second flow position when said second valve mechanism is in a second flow position, said second pumping means receiving said second fluid from a source thereof and operable for causing said second pumping means to deliver said second fluid to said demand station, (e) actuating means for causing said first and second pumping means to operate in a coordinate manner in said two directions and enabling said first valve and second valve to receive fluids from said first and second pumping means respectively in predetermined amounts, (f) a first mechanically operable actuating arm extending from said actuating means to said first valve for operating said first valve, said actuating means being connected to said first valve only by said first actuating arm, (g) a second mechanically operable actuating arm extending from said actuating means to said second valve for operating said second valve, said actuating means being connected to said second valve only by said second actuating arm, said first and second actuating arms being actuated simultaneously by said actuating means such that said first valve is shifted to the first flow position by said first actuating arm simultaneously with the second valve being shifted to the first flow position by the second actuating arm, and that said first valve is shifted to the second flow position by said first actuating arm simultaneously with the second valve being shifted to the second flow position by the second actuating arm, and (h) coupling means located to be actuated by said first or second pumping means, said coupling means being operatively connected to said actuating means to cause actuation of same when actuated by said first or second pumping means.

2. The apparatus of claim 1 further characterized in that a mixing means forms part of said apparatus and said first valve and second valve are operatively connected to said mixing means to enable a mixing of said first and second fluids.

3. The apparatus of claim 2 further characterized in that said actuating means comprises the first and second actuating arms which are the only means connecting said first valve and second valve to said respective first and second pumping means except for fluid lines between the first and second pumping means and the first valve and second valve.

4. The apparatus of claim 3 further characterized in that said coupling means is actuated by said pumping means and is connected to said actuating means for causing actuation of said first valve and second valve in response to actuation by said pumping means.

5. The apparatus of claim 2 further characterized in that said first and second pumping means are each dual acting piston-cylinder devices which are capable of pumping fluids in each of two directions.

6. The apparatus of claim 5 further characterized in that said first valve and second valve are each four way valves.

7. The apparatus of claim 2 further characterized in that said first fluid is a base liquid capable of being catalyzed and said second fluid is a liquid catalyst capable of being mixed with and catalyzing said base liquid.

8. The apparatus of claim 1 further characterized in that said first and second fluids are each liquids.

9. The apparatus of claim 1 further characterized in that said apparatus comprises:

(a) said demand station which receives the two combinable and cooperatable fluids in predetermined amounts, (b) said first pumping means is connected to said first valve and receives fluid from said first valve when the first valve means is in a first flow position, said first pumping means directs fluid to said first valve and through said first valve and to said demand station when said first valve is in the first flow position, (c) said second pumping means is connected to said second valve and receives fluid from said second valve when the second valve in a first flow position, said second pumping means directing fluid to said second valve and through said second valve when the second valve is in the first flow position.

10. The apparatus of claim 9 further characterized in that said first valve and second valve receive fluids from different portions of the respective first and second pumping means and permits fluid flow therethrough to said demand station when in a second flow position.

11. The apparatus of claim 1 further characterized in that said first valve housing and first valve mechanism being arranged so that fluid flow to said first pumping means may occur simultaneously with fluid flow to a receiving-demand means which receives the first and second fluids when in both the first flow position and second flow position, said second valve housing and second valve mechanism being arranged so that fluid flow to said second pumping means may occur simultaneously with fluid flow to the receiving-demand means when in both the first flow position and second flow position.

12. A metering system for delivering and metering two liquids in predetermined amounts, said metering system comprising:

(a) a first discrete pumping means comprised of a dual acting piston-cylinder arrangement capable of operating in two directions for pumping a first liquid, (b) a second discrete pumping means separated from said first pumping means and comprised of a dual acting piston-cylinder arrangement capable of operating in two directions for pumping a second liquid, (c) a mixing station for receiving said two liquids in predetermined amounts, (d) a first discrete valve means operatively connected to said first pumping means for receiving said first liquid from a source thereof and for delivery of said first liquid to said first pumping means, said first valve means also receiving the first liquid from said first pumping means when the first valve means is in a first flow position for delivery of said first liquid from said first pumping means and through said first valve means to said mixing station, said first valve being operable in a first flow position when first valve mechanism therein is in a first flow position and being operable in a second flow position when the first valve mechanism is in a second flow position, (e) a second discrete valve means operatively connected to said second pumping means for receiving said second liquid from a source thereof and for delivery of said second liquid to said second pumping means when the second valve means is in a first flow position, said second valve means directing the second liquid from said second pumping means and through said second valve means when the second valve means is in the first flow position to said mixing station, said second valve being operable in a first flow position when a second valve mechanism therein is in a first flow position and being operable in a second flow position when the second valve mechanism is in a second flow position, (f) an actuating means for controlling operation of said first and second valve means and thereby controlling operation of said first and second pumping means, (g) a first actuating arm operatively connecting said actuating means to said first valve means and thereby controlling operation of said first pumping means and said first valve means, (h) a second actuating arm operatively connecting said actuating means to said second valve means thereby controlling operation of said second pumping means and said second valve means, said first and second actuating arms being actuated simultaneously by said actuating means such that said first valve is shifted to the first flow position by said first actuating arm simultaneously with the second valve being shifted to the first flow position by the second actuating arm, and that said first valve is shifted to the second flow position by said first actuating arm simultaneously with the second valve being shifted to the second flow position by the second actuating arm, (i) a first coupling means operatively connecting said actuating means to said first pumping means to thereby control operation of said first valve means to enable said first pumping means to pump the first liquid to and from said first valve means in a predetermined proportion of the second pumping means pumping the second liquid to and from the second valve means, and (j) a separate second coupling means operatively connecting said actuating means to said second pumping means to thereby control operation of said second valve means to enable said second pumping means to pump the second liquid to and from said second valve means in a predetermined proportion of the first pumping means pumping the first liquid to and from the first valve means.

13. The system of claim 12 further characterized in that a coupling means is provided for actuating the said actuating means and hence the first and second actuating arms, and the coupling means is actuated by said first and second pumping means to in turn cause actuation of said first and second valve means.

14. The system of claim 13 further characterized in that said first and second pumping means are each dual acting piston-cylinder devices which are capable of pumping fluids in each of two directions.

15. The system of claim 14 further characterized in that said first and second valve means are each four way valves.

16. The system of claim 15 further characterized in that said actuating means also comprises a fluid operable cylinder and piston arrangement.

17. The system of claim 12 further characterized in that said first and second valve means receive fluids from different portions of the respective first and second pumping means and permits fluid flow therethrough to said mixing station when in a second flow position.

18. The system of claim 12 further characterized in that said first valve being arranged so that liquid flow to said first pumping unit may occur simultaneously with liquid flow to said mixing station when in both the first flow position and second flow position, said second valve being arranged so that liquid flow to said second pumping unit may occur simultaneously with liquid flow to said mixing station when in both the first flow position and second flow position.

19. An apparatus for pumping and metering first and second combinable and cooperable liquids which are reactable in order to form a compound resulting therefrom, said apparatus comprising:

(a) a first four way valve having a valve housing and a valve mechanism located therein to control a first liquid flow in either of first and second liquid flow positions, (b) a second four way valve having a valve housing and a second valve mechanism located therein to control a second liquid flow in either of first or second liquid flow positions, (c) a first pumping unit operatively connected to said first valve, said first pumping unit being connected to said first valve only by liquid delivery tubes, said first valve being adapted to provide for delivery of the first liquid to said first pumping unit in either of said first or second liquid flow positions and being adapted to receive the first liquid from said first pumping unit in either of said first or second liquid flow positions, said first valve also being adapted to provide for delivery of the first liquid through the first valve to a demand station, said first valve also being arranged so that liquid flow to the demand station may occur simultaneously with liquid flow to the first pumping unit in both of the first and second liquid flow positions, (d) a second pumping unit operatively connected to said second valve, said second pumping unit being connected to said second valve only by liquid delivery tubes, said second valve being adapted to provide for delivery of the second liquid to said second pumping unit in either of said first or second liquid flow positions and being adapted to receive the second liquid from the second pumping unit in either of the first or second liquid flow positions, said second valve also being adapted to provide for delivery of the second liquid through the second valve to said demand station, said second valve also being arranged so that liquid flow to the demand station may occur simultaneously with liquid flow to the second pumping unit in both of said first and second liquid flow positions, (e) an actuating unit operatively connected to each of said first and second valves, said actuating unit being connected to said first and second valves only by respective first and second actuating arms, said first and second actuating arms being actuated simultaneously by said actuating means such that said first valve is shifted to the first flow position by said first actuating arm simultaneously with the second valve being shifted to the first flow position by the second actuating arm, and that said first valve is shifted to the second flow position by said first actuating arm simultaneously with the second valve being shifted to the second flow position by the second actuating arm, and (f) first and second coupling elements located to be actuated by said first and second pumping units and said actuating units also being operatively connected to said first and second pumping units only by said first and second coupling elements.

20. The apparatus of claim 19 further characterized in that said first and second pumping means are each dual acting piston-cylinder devices which are capable of pumping fluids in each of two directions.

21. A metering system for delivering and metering two liquids in predetermined amounts, said metering system comprising:

(a) a first discrete pumping means comprised of a dual acting piston-cylinder arrangement capable of operating in two directions for pumping a first liquid, (b) a second discrete pumping means separated from said first pumping means and comprised of a dual acting piston-cylinder arrangement capable of operating in two directions for pumping a second liquid, (c) a mixing station for receiving said two liquids in predetermined amounts, (d) a first discrete four way valve having a first valve housing and a first actuable valve mechanism in said first valve housing, said first valve being operable in a first flow position when said first valve mechanism is in a first flow position and being operable in a second flow position when said first valve mechanism is in a second flow position, said first valve being operatively connected to said first pumping means for receiving said first liquid from a source thereof and for delivery of said first liquid to said mixing station, said first valve also receiving the first liquid from said first pumping means when the first valve is in said first flow position for delivery of said first liquid from said first pumping means and through the first valve housing and first valve mechanism of said first valve to said mixing station, said first valve housing and first valve mechanism being arranged so that liquid flow to said first pumping means may occur simultaneously with liquid flow to a receiving-demand means when in both the first flow position and second flow position, (e) a second discrete four way valve having a second valve housing and a second actuable valve mechanism in said second valve housing, said second valve being operable in a first flow position when said second valve mechanism is in a first flow position and being operable in a second flow position when said second valve mechanism is in a second flow position, said second valve being operatively connected to said second pumping means for receiving said second liquid from a source thereof and for delivery of said second liquid to said mixing station, said second valve also receiving the second liquid from said second pumping means when the second valve is in the first flow position for delivering of said second liquid from said second pumping means and through the second valve housing and second valve mechanism of said second valve to said mixing station, said second valve housing and second valve mechanism being arranged so that liquid flow to said second pumping means may occur simultaneously with liquid flow to said receiving-demand means when in both the first flow position and second flow position, (f) a fluid operable actuating mechanism for controlling operation of said first and second valves and thereby controlling operation of said first and second pumping means, (g) a first actuating arm operable by said actuating mechanism and being connected to said first valve for controlling operation of said first valve and hence said first pumping means, said actuating mechanism being connected to said first valve only by said first actuating arm, (h) a second actuating arm operable by said actuating mechanism and being connected to said second valve for controlling operation of said second valve and hence said second pumping means, said actuating mechanism being connected to said second valve only by said second actuating arm, said first and second actuating arms being actuated simultaneously by said actuating means such that said first valve is shifted to the first flow position by said first actuating arm simultaneously with the second valve being shifted to the first flow position by the second actuating arm, and that said first valve is shifted to the second flow position by said first actuating arm simultaneously with the second valve being shifted to the second flow position by the second actuating arm, (i) a mechanical coupling for connecting the pistons in each of said discrete first and second pumping means together such that said pistons are generally aligned, (j) a first fluid operable coupling member operable by said mechanical coupling and being operatively connected to said actuating mechanism to thereby cause said actuating mechanism to control said first valve in response to positions of the pistons in the first and second pumping means to thereby enable the first pumping means to pump the first liquid to and from said first valve in a predetermined proportion of the second pumping means pumping the second liquid to and from the second valve, and (k) a second fluid operable coupling member operable by said mechanical coupling and being operatively connected to said actuating mechanism to thereby cause said actuating mechanism to control said second valve in response to positions of the pistons in the first and second pumping means and to thereby enable the second pumping means to pump the second liquid to and from said second valve in a predetermined proportion of the first pumping means pumping the first liquid to and from the first valve.

* * * * *